US006269509B1

(12) United States Patent
Mays

(10) Patent No.: US 6,269,509 B1
(45) Date of Patent: Aug. 7, 2001

(54) AUTOMATED APPARATUS FOR CLEANING GOLF BALLS

(76) Inventor: Audie L. Mays, 90 Eugenia Dr., Killen, AL (US) 35645

( * ) Notice: Subject to any disclaimer, the term of this patent is extended or adjusted under 35 U.S.C. 154(b) by 0 days.

(21) Appl. No.: 09/222,981

(22) Filed: Dec. 30, 1998

(51) Int. Cl.[7] ..... B08B 1/00; B08B 13/00

(52) U.S. Cl. ..... 15/21.2; 15/3.1; 15/3.12; 15/3.13; 15/3.15; 15/3.16; 15/3.18; 15/3.19; 15/3.2; 15/DIG. 11; 134/61; 134/65; 134/57 R; 134/191; 137/551; 137/558

(58) Field of Search ..... 15/21.2, 3.1, 3.12, 15/3.13, 3.15, 3.16, 3.18, 3.19, 3.2, DIG. 11; 134/61, 65, 57 R, 191; 137/551, 558

(56) References Cited

U.S. PATENT DOCUMENTS

| | | | | |
|---|---|---|---|---|
| 1,222,645 | * | 4/1917 | McIntosh | 15/3.2 |
| 2,005,115 | * | 6/1935 | Stutz | 15/21.2 |
| 2,690,576 | * | 10/1954 | Dreesman | 15/3.2 |
| 2,824,318 | * | 2/1958 | Marzolf | 15/3.13 |
| 2,877,475 | * | 3/1959 | Henry | 15/3.16 |
| 3,733,633 | | 5/1973 | Gustafson . | |
| 4,011,619 | | 3/1977 | Michalak . | |
| 4,698,867 | * | 10/1987 | Kuhl | 15/3.13 |
| 4,881,287 | | 11/1989 | Knez . | |
| 4,988,978 | * | 1/1991 | Soto | 137/558 |
| 5,155,883 | | 10/1992 | Legault . | |
| 5,285,548 | * | 2/1994 | Moll | 15/3.16 |
| 5,353,822 | * | 10/1994 | Gutterman et al. | 134/65 |
| 5,361,440 | * | 11/1994 | Buchbinder et al. | 15/21.2 |
| 5,400,455 | | 3/1995 | Crossley . | |
| 5,454,877 | | 10/1995 | Worsham . | |
| 5,499,641 | * | 3/1996 | Weimer et al. | 134/65 |
| 5,524,311 | | 6/1996 | Crossley . | |
| 5,529,080 | * | 6/1996 | Minkin | 134/57 R |
| 5,598,597 | | 2/1997 | Templeton . | |
| 5,772,778 | | 6/1998 | Back . | |
| 5,887,616 | * | 3/1999 | Ikeda et al. | 137/558 |

FOREIGN PATENT DOCUMENTS

| | | | |
|---|---|---|---|
| 2270474 | * | 3/1994 | (GB) . |
| 315382 | * | 2/1934 | (IT) . |
| 591168 | * | 4/1959 | (IT) . |
| 636048 | * | 12/1978 | (SU) . |

* cited by examiner

*Primary Examiner*—Robert J. Warden, Sr.
(74) *Attorney, Agent, or Firm*—Robert J. Veal; Robert M. Jackson; Burr & Forman LLP

(57) ABSTRACT

An automated apparatus for cleaning golf balls constructed of light weight, portable type material and operable via standard battery power. The apparatus utilizes a housing having a fluid reservoir in the lower portion for holding a cleaning fluid, and a screw-type driven auger along with a pair of driven brushes and a fluid spray nozzle in the upper portion. A driven pump transports the cleaning fluid from the reservoir to the nozzle, which sprays the cleaning fluid on the golf ball as the auger and brushes engage the ball and remove the soil, respectively. Multiple sensing means are employed to energize and disable the apparatus upon the occurrence of predetermined events.

10 Claims, 6 Drawing Sheets

13
12
16
17
14
20
15
22
18

AUTOMATED APPARATUS FOR CLEANING GOLF BALLS

FIELD OF THE INVENTION

The present invention relates to the field of golf ball cleaning apparatus used to remove soil, grass stains, and other debris from golf balls. More particularly, the present invention relates to a golf ball cleaning apparatus which is lightweight, portable, and can be easily mounted on a golf cart or a stationary stand. With even greater particularity, the present invention relates to a golf ball cleaning apparatus which can be attached to a golf cart or stationary stand and is capable of cleaning more than one ball at a time. With even further particularity, the present invention relates to a battery operated multiple golf ball cleaning apparatus which can be attached to a golf cart or stationary stand.

BACKGROUND OF THE INVENTION

Continual equipment maintenance is a common and well known obstacle encountered by nearly all sportsmen while participating in their respective sports. Although certain ball related sports do not allow for washing of the ball during play, in the case of golf, it is highly desirable to periodically wash the ball such that debris or grass stains on the ball surface will not affect the ball's flight characteristics. Golf courses typically attempt to remedy this problem via the placement of manually operated ball washers near the tee boxes of each hole; however, such apparatus are clumsy, difficult to use, and troublesome to maintain given their inherent distance from the maintenance facilities of the golf course.

The prior art reveals a number of golf ball cleaners, which are easily categorized as the following: First, heavy-duty electrical ball washers which are designed to wash a large quantity of balls in a relatively short time and are not portable; Second, hand operated ball washers which are both fixed and portable; and Third, portable hand-held ball washers which typically operate on a battery.

The first category of machines, those designed to clean a high volume of balls and typically operate on a standard AC power source, are evidenced in U.S. Pat. No. 3,733,633, which discloses an apparatus for cleaning a high volume of golf balls utilizing a hopper having a rotatable drum and a pair of cleansing brushes rotating in opposite directions through which golf balls pass and are cleaned. U.S. Pat. No. 5,454,877 also discloses a high volume fixed type machine, which utilizes a bin placed above a hopper for manipulating balls into a staging section. The staging section transports the balls through both rotating and stationary brushes, which are sprayed with a cleaning solution. Upon exit from the cleaning brushes, the balls are rinsed and dried via forced air, and are then deposited in a collection bin proximate the apparatus. Additionally, U.S. Pat. Nos. 5,772,778 and 4,881,287 disclose similar fixed type high volume golf ball cleaning apparatus.

Hand operated machines present in the prior art include U.S. Pat. Nos. 5,155,883 and 4,011,619. The '883 patent discloses combination golf ball and club washer having a water tight housing with a plurality of brushes mounted within, such that a golf ball or club can be manually agitated within the housing proximate the brushes so that dirt and soil are removed. The '619 patent reveals a hand operated golf ball washer, which scrubs, cleans, and dries the balls. The apparatus includes a hand-crank operated washer comprising a cylindrical container in which there is an elongated drive shaft connected to the exterior hand-crank, which is supporting a scrubbing element, a cleaning element, and a drying element on the interior of the cylinder.

The hand-held battery operated ball washers in the prior art include U.S. Pat. No. 5,598,597, for an Electric Roller Ball Cleaning Device. This device includes a cup having brushes mounted therein for holding a ball to be cleaned. Opposite the cup is an agitation means, which rotates the ball within the cup having brushes upon engaging the ball. U.S. Pat. No. 5,400,455 also discloses a hand-held type golf ball washer which operates on batteries. This apparatus includes a receiving chamber wherein a ring-shaped driven brush is positioned such that when the receiving chamber is closed, the brush agitates and cleans the ball. Another battery operated hand-held washer is disclosed in U.S. Pat. No. 5,524,311. This washer also incorporates a ball receiving chamber and a motor for driving a ball washing brush when the chamber is closed.

Therefore, although numerous apparatus and devices are present in the prior art for washing golf balls, the present ball washers are typically fixably mounted and capable of washing multiple balls, or portable and not capable of washing multiple balls.

SUMMARY OF THE INVENTION

It is the object of the present invention to provide an automated golf ball washer utilizing light weight and inexpensive materials. It is a further object of the present invention to provide an automated golf ball washer capable of washing more than one ball at a time. It is a further object of the present invention to provide an automated golf ball washer which is portable. Further, it is an object of the present invention to provide an automated golf ball washer which operates on typical battery voltages.

BRIEF DESCRIPTION OF THE DRAWINGS

An apparatus embodying the features of the present invention is depicted in the accompanying drawings, which form a portion of this disclosure, wherein.

DETAILED DESCRIPTION OF THE PREFERRED EMBODIMENT

Figure 1:
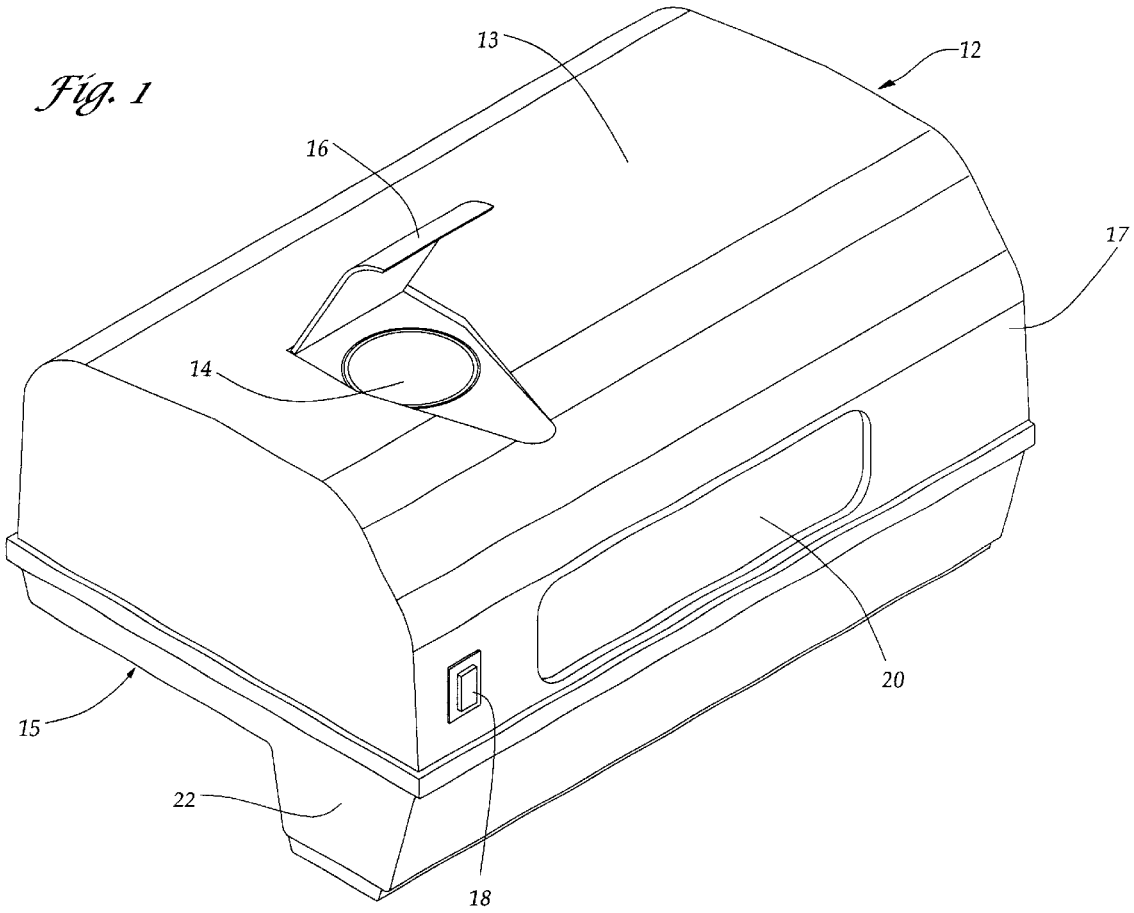
FIG. 1 is a perspective view of the apparatus.
Figure 2:
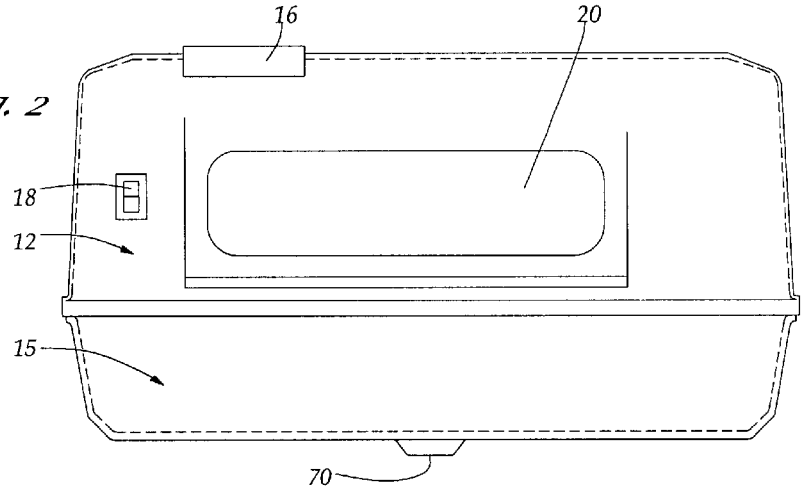
FIG. 2 is a front elevational view.
Figure 3:
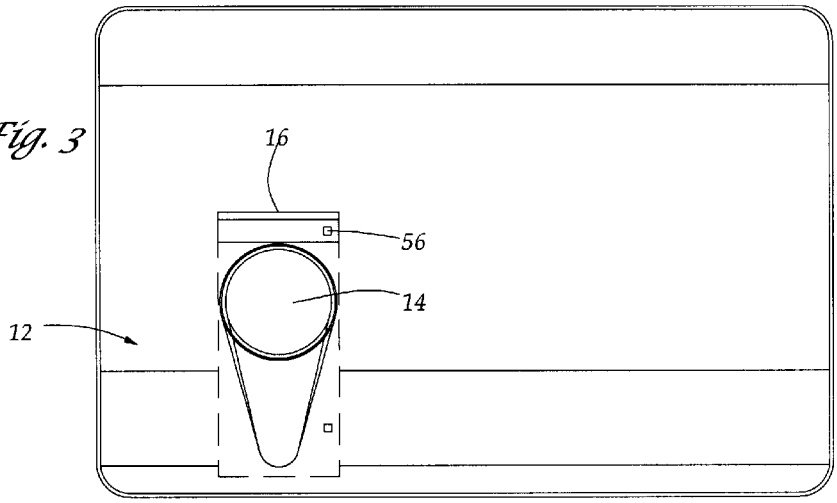
FIG. 3 is a top plan view.
Figure 4:
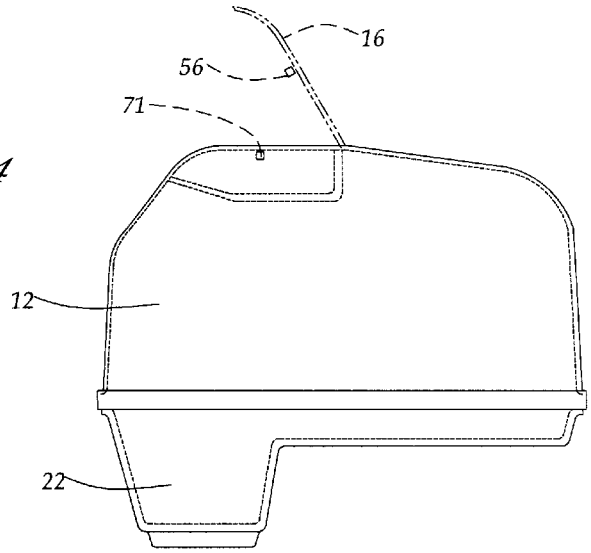
FIG. 4 is a side elevational view.
Figure 7:
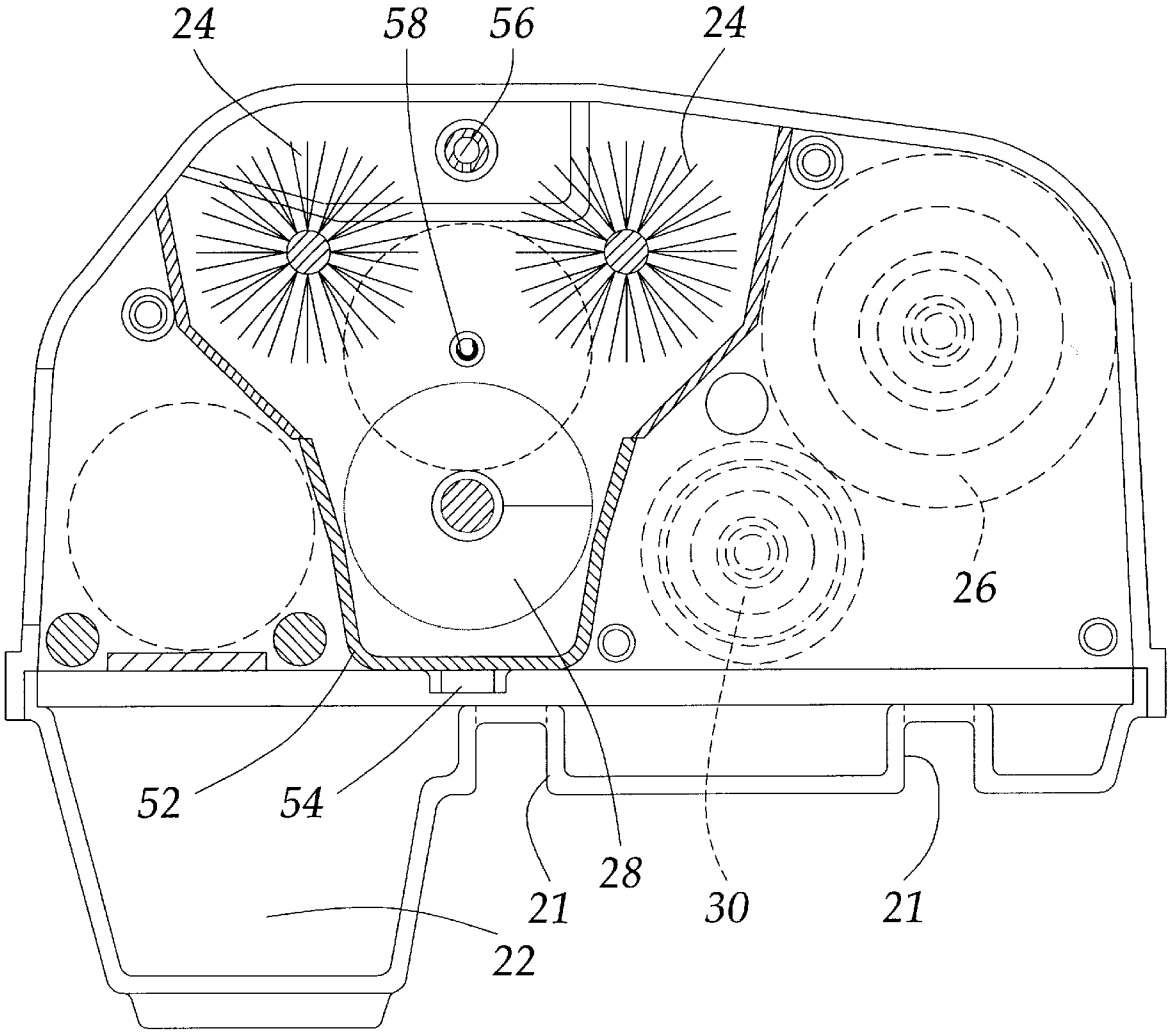
FIG. 7 is a sectional view of the apparatus taken along line 7—7 of FIG. 5.
Figure 8:
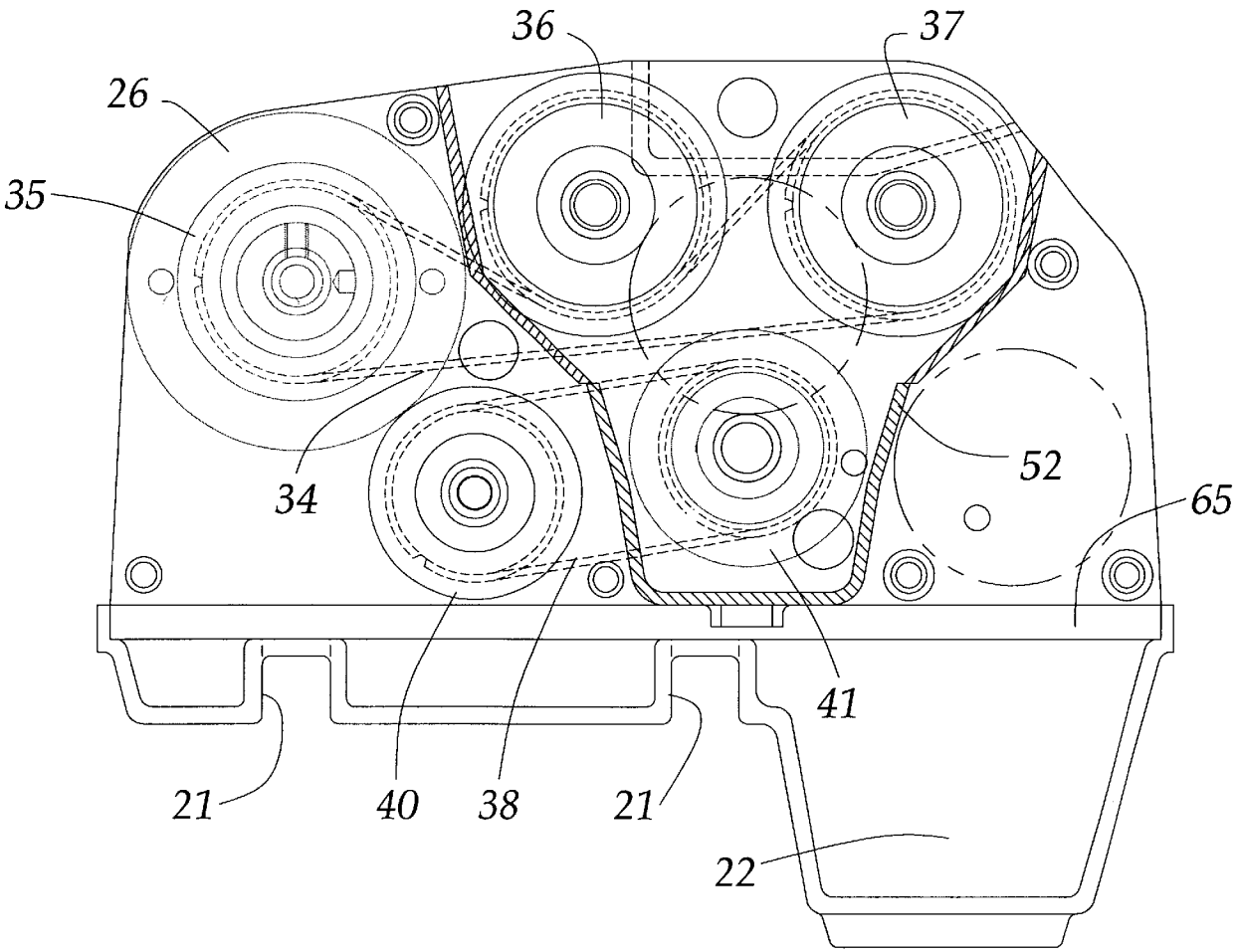
FIG. 8 is a sectional view of the apparatus taken along line 8—8 of FIG. 5.

Referring to the drawings for a better understanding of the principles of operation and structure of the invention, it will be seen that FIG. 1 shows a perspective view of the apparatus. The apparatus provides a housing 12 having a pivotally mounted door 16 positioned on the upper portion 13 of housing 12, which shields the golf ball entry channel 14. The front portion 17 of housing 12 has an elongated exit channel 20 for holding the clean golf balls exiting the apparatus, along with a main power switch 18. The lower portion 15 of housing 12, also shown in FIGS. 4, 7, and 8, shows the general mounting connections 21 for the cleaner, the exterior of an elongated cleaning fluid reservoir 22, and the cleaning fluid reservoir drain hole 70. Mounting connections 21 are designed to accept numerous general purpose mounting schemes, including typical bolt type mounting schemes.

Figure 5:
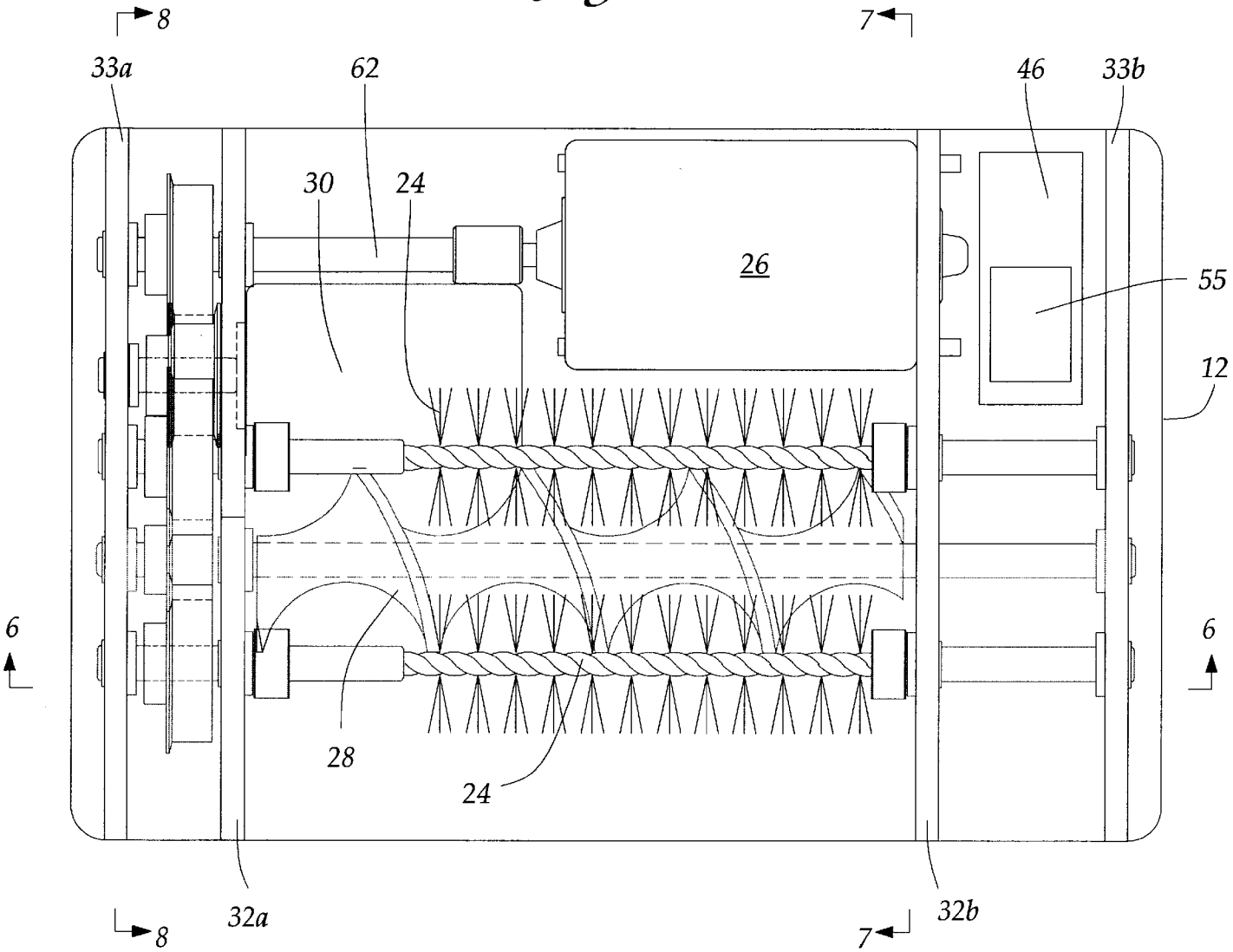
FIG. 5 is a top plan view of the apparatus with the upper housing removed.
Figure 6:
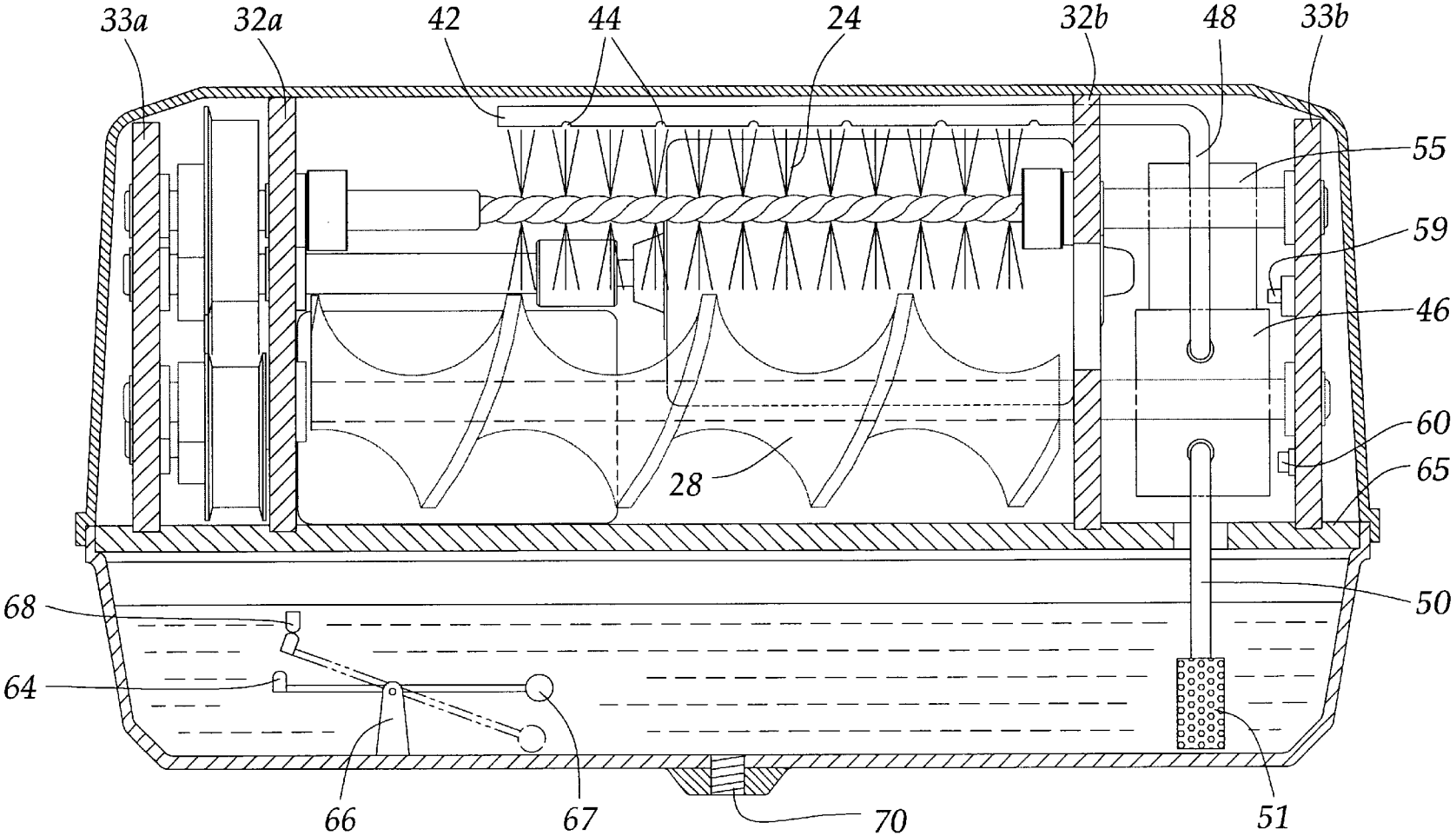
FIG. 6 is a sectional view of the apparatus taken along the line 6—6 of FIG. 5.

The top view of the apparatus, as shown in FIG. 5 of the drawings, clearly illustrates the internal elements of the apparatus. An elongated screw-type auger 28 is rotatably mounted between inner vertical support members 32*a* and 32*b*, which are attached and supported by horizontal support member 65. Auger 28 functions to urge the golf balls to be cleaned through the apparatus, while also causing a skewed rotation of the ball, such that all surfaces of the ball are exposed to the cleaning elements of the apparatus. Positioned above auger 28 is a pair of elongated steel shaft nylon bristle brushes 24, for removing soil and grass stains from the golf balls, which are also rotatably mounted between inner vertical support members 32*a* and 32*b*. Pair of brushes 24 are mounted above auger 28, such that a triangular configuration between brushes 24 and auger 28 is formed, as shown in FIG. 7. The center of the triangle created by brushes 24 and auger 28 represents the path of the golf ball to be cleaned by the apparatus. Although the preferred embodiment utilizes a screw-type auger 28 for urging the golf ball through the cleaner, alternative structures for urging the ball through the apparatus are contemplated. Such alternative structures include, but are not limited to various belt and pulley assemblies, conveyors, and gravity feed type devices. Additionally, alternative structures accomplishing the scrubbing or cleaning function of the elongated steel shaft nylon bristle brushes 24 are contemplated.

A first electric motor, brush motor 26, causes brushes 24 to rotate during the cleaning operation of the apparatus. A brush belt 34 engages brushes 24 and causes their rotation via three pulleys mounted between inner vertical support member 32*a* and outer vertical support member 33*a*, which are shown in FIG. 8. The three pulleys are: First, brush motor pulley 35; Second, first brush pulley 36; and, Third, second brush pulley 37 which is of equal size to first brush pulley 36. Brush belt 34 is driven by brush motor 26 via brush motor shaft 62 and brush motor pulley 35. Brush belt 34 fully engages second brush pulley 37, which is attached to the rotating axis of brush 24, such that brush 24 attached to second brush pulley 37 rotates in the same direction as the brush motor pulley 35. Brush belt 34 partially engages brush pulley 36, which is attached to the rotating axis of brush 24, such that brush 24 attached to first brush pulley 36 rotates in the opposite direction of brush motor pulley 35 and second brush pulley 37, thus creating a pair of counter-rotating brushes 24 in the preferred embodiment. The rate of rotation of brushes 24 can be adjusted by varying the pulley ratio between brush motor pulley 35 and the two brush pulleys 36 and 37. A higher pulley ratio yields faster brushes 24. Additionally, it is contemplated that brushes 24 or brush pulleys 36 and 37 could be of different sizes, such that brushes 24 rotate at different speeds. These variances in rotation speeds between brushes 24 are likely to cause the ball to rotate within auger 28, such that the ball is better cleaned and possibly further urged through the apparatus. It is also contemplated that the pulley and brush assembly be configured such that brushes 24 rotate in the same direction, again causing the ball to rotate on the auger and therefore causing a greater exposure of the ball surface to the cleaning elements of the apparatus.

A second electric motor, auger motor 30, causes auger 28 to rotate during the operation of the apparatus via auger belt 38. Auger belt 38 is engaged by auger motor 30 via direct connection to auger motor pulley 40. Auger belt 38 extends from auger motor pulley 40 to auger pulley 41, which connects directly to the rotating axis of auger 28, such that auger 28 is caused to rotate in the same direction as second electric motor 30. The direction of rotation of auger motor 30 is predetermined to be the direction of rotation which will rotate auger 28 in a direction which will transport golf balls through the apparatus from entry channel 14 to exit channel 20. The rate at which the ball to be cleaned travels throughout the apparatus can be adjusted by varying the pulley ratio between auger motor pulley 40 and auger pulley 41. A higher ratio translates to a faster transmission through the apparatus; however, the quicker rate yields a lesser time the ball will be scrubbed by brushes 24. The apparatus will generally be able to clean a heavily soiled ball utilizing approximately six to eight seconds of exposure to the brushes. The utilization of a dual motor system along with gear type belts and pulleys in the preferred embodiment, although effective, is nonetheless not meant to limit the scope of this disclosure. Single or multiple motors are contemplated, along with various belt, pulley, gear, and brush rotation schemes.

An elongated nozzle 42 having a plurality of apertures 44 on the side of elongated nozzle 42 proximate auger 28, is positioned directly above the axis of rotation of auger 28, above and between brushes 24. Although nozzle 42 is immediately above auger 28, it is of a sufficient distance from auger 28 to allow for a golf ball to be transported by auger 28. Nozzle 42 is connected to pump 46 via fluid hose 48. Pump 46 includes a fluid pickup hose 50 having a screen type filter 51 attached to the end of fluid pickup hose 50, which extends from pump 46 into fluid reservoir 22, through horizontal support member 65. Pump 46 transports a cleaning fluid from reservoir 22 to nozzle 42 via hose 48 and pickup hose 50, such that nozzle 42 is pressurized by the cleaning fluid. Pressurization of nozzle 42 causes the cleaning fluid to be sprayed upon a golf ball being transported by auger 28, through apertures 44. Although the preferred embodiment utilizes elongated nozzle 42 for spraying fluid on the golf balls being cleaned by the apparatus, numerous methods and structures for spraying fluid are currently available, and are thus contemplated for use within the current apparatus. Reservoir 22 can be filled with cleaning fluid by simply opening door 16 and pouring the fluid into the apparatus. The fluid will be directed into reservoir 22 by trough 52 and fluid return drain 54.

The fluid sprayed on the golf ball by elongated nozzle 42 is maintained proximate auger 28 and brushes 24 by trough 52, which is shown in FIGS. 7 and 8. Trough 52 extends longitudinally between inner vertical support members 32*a* and 32*b*, and includes a fluid return drain 54 for returning the fluid sprayed by apertures 44 to the fluid reservoir 22, such that the fluid can be reused by the apparatus. Pivotally mounted float 66, which is positioned within reservoir 22, operates to indicate the level of fluid in reservoir 22 to electronic controller 55. Pivotally mounted float 66 has an indicator end 64 and a float end 67. Float end 67 is constructed of a material having a lesser density than the cleaning fluid present in reservoir 22, such that float end 67 is continually positioned proximate the top of the fluid level present in reservoir 22. Indicating end 64 is caused to pivot upward by float end 67 and indicate proximity to fluid proximity sensor 68, which is in electrical connection with electronic controller 55, when the fluid level in reservoir 22 becomes low. Although fluid proximity sensor 68 is depicted as being positioned within reservoir 22, the nature of proximity sensors allows for placement of fluid proximity sensor 68 in various locations. Additionally, numerous alternative fluid level sensors are contemplated for use in the present invention in place of the float-type proximity sensor utilized in the illustrated embodiment.

The apparatus is caused to operate in a two step process: First, the main power switch 18 must be placed in the "on" position; and, Second, a ball must be deposited in the entry channel 14 under door 16. Initiating power switch 18 does not activate the apparatus, it only provides power to the electronic controller 55 of the apparatus, which enters into a standby mode. Door 16, which covers entry channel 14, has an indicating device 56 mounted on the underside of door 16, which is detected by door proximity sensor 71, located immediately within housing 12, proximate door 16. Door proximity sensor 71 is in electrical connection with electronic controller 55, such that electronic controller 55 stops the apparatus upon indication of the opening of door 16. When a ball is inserted into entry channel 14, it falls directly onto auger 28, and is detected by a photo-detection device 58. Photo-detection device 58 is mounted within inner vertical support member 32*a* just above auger 28, such that photo-detection device 58 is directly in the path of a golf ball engaged by auger 28. Positioned immediately opposite photo-detection device 58 is a light emission source 59, which is mounted within outer vertical support member 33*b*. Light emission source 59 projects light towards photo-detection device 58 directly in the path of a golf ball engaged by auger 28, such that photo-detection device 58 is able to indicate the presence of a golf ball in auger 28. Photo-detection device 58, being in electrical connection with electronic controller 55, causes the apparatus to energize when a ball is inserted into entry channel 14 and falls onto auger 28, as photo-detection device 58 indicates the presence of a golf ball to be cleaned to electronic controller 55. Electronic controller 55 causes auger motor 30, brush motor 26, and pump 46 all to initiate operation. Auger 28 thereafter begins to move the ball through the apparatus such that all surfaces of the ball contact counter-rotating brushes 24 as nozzle 42 simultaneously sprays a cleaning fluid on the ball, all of which results in the soil being scrubbed from the ball's surface. When the ball exits from auger 28, it is deposited in exit channel 20 for removal by the golfer. The apparatus also incorporates a mechanical limit type sensor 60 for determining the presence of excess balls in the exit channel, positioned proximate the termination point of auger 28, such that when exit channel 20 becomes full of clean balls, the apparatus is caused to shut down by electronic controller 55, thus avoiding binding or jamming of the apparatus due to excess balls in exit channel 20.

Electronic controller 55, as shown in FIG. 5 regulates the operation of the apparatus. Electronic controller 55 utilizes standard comparator type circuit logic for controlling the operation of the apparatus, and can be constructed using common operational amplifiers, diodes, resistors, and capacitors in typical configurations. Electronic controller 55 utilizes input from power switch 18, door proximity sensor 71, located proximate door 16 on housing 12, photo-detector 58, located directly above the auger 28, mechanical limit type sensor 60 located proximate the termination point of auger 28, and fluid proximity sensor 68. Power switch 18 initializes electronic controller 55, such that the apparatus is ready for operation; however, standby mode is initially maintained by electronic controller 55. Actual operation of the apparatus is initiated by photo-detector 58, which senses the presence of a ball deposited onto auger 28 via entry channel 14. Once photo-detector 58 indicates the presence of a ball, electronic controller 55 energizes auger motor 26, brush motor 30, and pump 46 such that all functions of the apparatus are operating to clean the ball. The ball is transported by auger 28 through counter-rotating brushes 24, while pump 46 simultaneously causes nozzle 42 and apertures 44 to spray cleaning fluid on the ball.

Operation of the apparatus is automatically caused to halt by one of five occurrences. First, if the ball inserted into the apparatus is transported through brushes 24 by auger 28, and is deposited in the exit channel 20, then photo-detector 58, which is positioned immediately above auger 28, will indicate the presence of no balls to be cleaned on auger 28 to electronic controller 55, which de-energizes pump 46, auger motor 26, and brush motor 30. Second, if door 16 is opened during the operation of the apparatus, then proximity sensor 56 will indicate the open door to electronic controller 55, which again de-energizes pump 46, auger motor 26, and brush motor 30. The third method of shut-down of the apparatus occurs when exit channel mechanical limit type sensor 60 indicates that exit channel 20 is full of clean balls. The apparatus is shut-down in this instance to avoid jamming or binding auger 28. The fourth method of shutting down the apparatus occurs when fluid proximity sensor 68 indicates a low level of cleaning fluid in reservoir 22. This method of halting the operation of the apparatus is designed to insure that pump 46 is not operated without fluid in reservoir 22, such that the pump life is significantly extended. The final method of shutting down the apparatus involves the manual switching of power switch 18 to the "off" position, removing power from the apparatus.

It is to be understood that the form of the invention shown is a preferred embodiment thereof and that various changes and modifications may be made therein without departing from the spirit of the invention or scope as defined in the following claims.

I claim:

1. An automated apparatus for cleaning one or more golf balls comprising:

a) a driven screw-type auger;

b) at least two driven brushes positioned proximate said driven screw-type auger;

c) an elongated nozzle for dispensing a cleaning fluid positioned proximate said driven brushes;

d) a housing having a hinged door positioned proximate said driven screw-type auger for inserting said one or more golf balls to be cleaned;

e) at least one sensing means;

f) a control means having at least one input for connection to said sensing means and at least one output for energizing said driven screw-type auger, said driven brushes, and said elongated nozzle; and g) a means in electrical connection with said control means for sensing the position of said hinged door.

2. Apparatus as defined in claim 1, wherein said driven screw-type auger is engaged by a single gear belt and pulley arrangement.

3. Apparatus as defined in claim 1, wherein said driven brushes are engaged by a single gear belt and pulley assembly.

4. Apparatus as defined in claim 1, wherein said elongated nozzle is in fluid communication with a pumping means for pumping said cleaning fluid from a reservoir to said nozzle.

5. Apparatus as defined in claim 4, wherein said elongated nozzle has a plurality of apertures for spraying said cleaning fluid on said one or more golf balls.

6. Apparatus as defined in claim 1, further comprising a means in electrical connection with said control means for sensing the presence of said one or more golf balls proximate said driven screw-type auger.

7. Apparatus as defined in claim 1, further comprising a means in electrical connection with said control means for sensing the presence of a predetermined number of said golf balls within said apparatus.

8. Apparatus as defined in claim 1, further comprising a means in electrical connection with said control means for sensing a low level of said cleaning fluid.

9. Apparatus as defined in claim 8, wherein said means for sensing a low level of fluid comprises a pivotally mounted float member having a first end and a second end, said first end having an attached float, said second end having an attached indicator, and a means in electrical connection with said control means for sensing contact with said indicator.

10. An automated apparatus for cleaning one or more golf balls comprising:

a) a driven screw-type auger;

b) at least two driven brushes positioned proximate said driven screw-type auger;

c) an elongated nozzle for dispensing a cleaning fluid positioned proximate said driven brushes;

d) at least one sensing means;

e) a control means having at least one input for connection to said sensing means and at least one output for energizing said driven screw-type auger, said driven brushes, and said. elongated nozzle; and, f) a means in electrical connection with said control means for sensing the presence of said one or more golf balls proximate said driven screw-type auger.

* * * * *